United States Patent [19]

Fiorani

[11] 4,372,281

[45] Feb. 8, 1983

[54] SPRING TYPE BOOMERANG PROJECTING PISTOL

[75] Inventor: Franco Fiorani, Modena, Italy

[73] Assignee: Dulcop International S.p.A., S. Lazzaro Di Savena, Italy

[21] Appl. No.: 170,415

[22] Filed: Jul. 21, 1980

[51] Int. Cl.[3] ..... F41B 7/00

[52] U.S. Cl. ..... 124/16; 124/51 R; 124/44; 124/53

[58] Field of Search ..... 124/41 R, 16, 36, 44, 124/45, 1, 49, 51 R, 53

[56] References Cited

U.S. PATENT DOCUMENTS 1,759,471 5/1930 Tantlinger ..... 124/44 X 2,943,619 7/1960 Dunbar ..... 124/44 X

*Primary Examiner*—Richard C. Pinkham

*Assistant Examiner*—William R. Browne

*Attorney, Agent, or Firm*—Guido Modiano; Albert Josif

[57] ABSTRACT

A toy pistol for repeated launching of boomerangs. The pistol has a magazine for receiving a plurality of boomerangs in side by side relationship and a launching chamber in which a boomerang projecting lever is articulated. The lever is subjected to the action of a spring and provided with a gripper for gripping a boomerang. The lever is controlled by a trigger which causes displacement of a boomerang from said magazine into a gripping position and rotation of the lever to load said spring and to grip said boomerang. After gripping of the boomerang the trigger releases the lever which snaps back thereby throwing the boomerang.

3 Claims, 6 Drawing Figures

SPRING TYPE BOOMERANG PROJECTING PISTOL

BACKGROUND OF THE INVENTION

This invention relates to a toy pistol.

Known are toys which are intended for throwing objects of various description to a distance away, such as toy airplanes, rotors, parachutes, and the like, in order for children to play therewith.

Along that same line, the idea has been conceived that objects in the form of boomerangs may also be thrown which will follow unusual paths to return to their launching site.

SUMMARY OF THE INVENTION

This invention sets out to provide, in fact, a toy pistol capable of throwing small boomerangs, which pistol is of simple construction, easy to use, and a sure attention-catcher.

Within that general aim, it can be further arranged that the aforesaid toy pistol can launch small boomerangs in succession.

According to one aspect of this invention, there is provided a toy pistol, characterized in that it comprises a loading and releasing trigger, and a housing adapted for accommodating a small boomerang therein and carrying hinged thereto a lever subjected to the action of elastic means, which lever configures a sort of elastic gripper adapted for gripping the boomerang as placed in said housing and is controllable by means of said trigger to perform an angular movement toward said housing to load said elastic means and grip the boomerang, said boomerang, during the reverse angular movement of said lever, as determined by said elastic means, being driven thereby and then launched or thrown away against the gripping action of said gripper.

BRIEF DESCRIPTION OF THE DRAWINGS

Further features will become more clearly apparent from a detailed description of a toy pistol according to the invention, as illustrated by way of example in the accompanying drawings, where.

DESCRIPTION OF THE PREFERRED EMBODIMENTS

Figure 1:
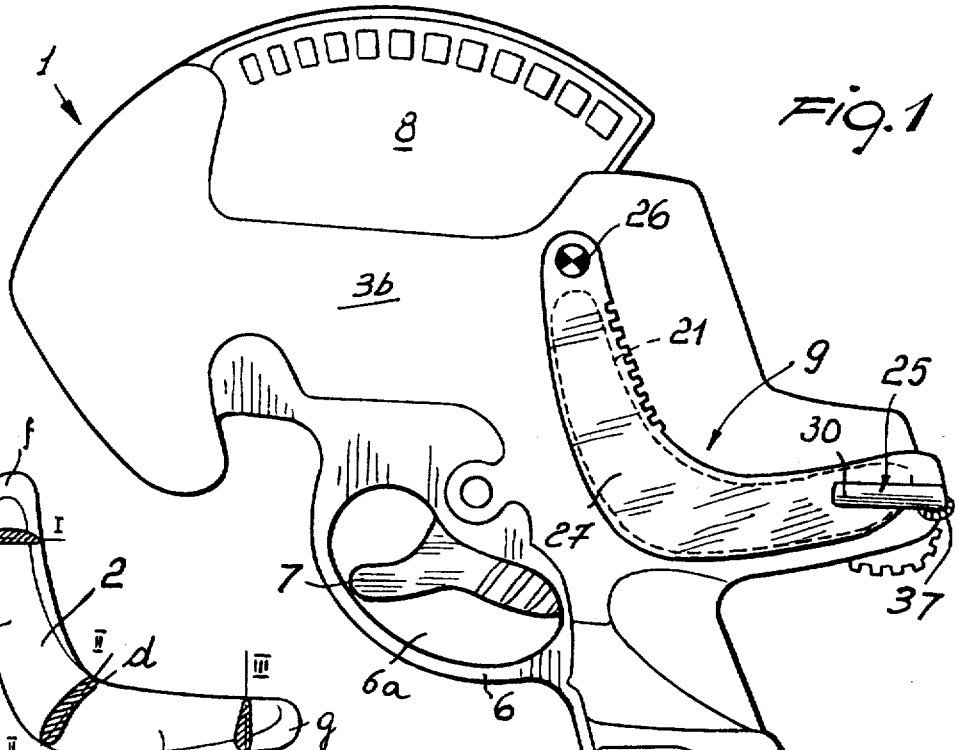
FIG. 1 is a side view of a toy pistol for launching boomerangs, according to the invention.

With reference to the drawing figures, this toy pistol 1, capable of throwing a small boomerang 2, has a body comprising a pair of plates 3*a* and 3*b*, preferably molded from a plastics material. The plates 3*a*, 3*b* are arranged to face each other and are interconnected, preferably by means of pin members formed in one of said plates and pressed into corresponding recesses in the other plate. The pin members and related recesses are indicated at 4 in the figures.

Figure 2:
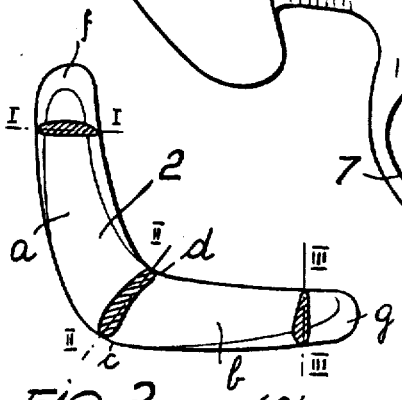
FIG. 2 is a side view of a boomerang with cross-sectional views thereof.
Figure 3:
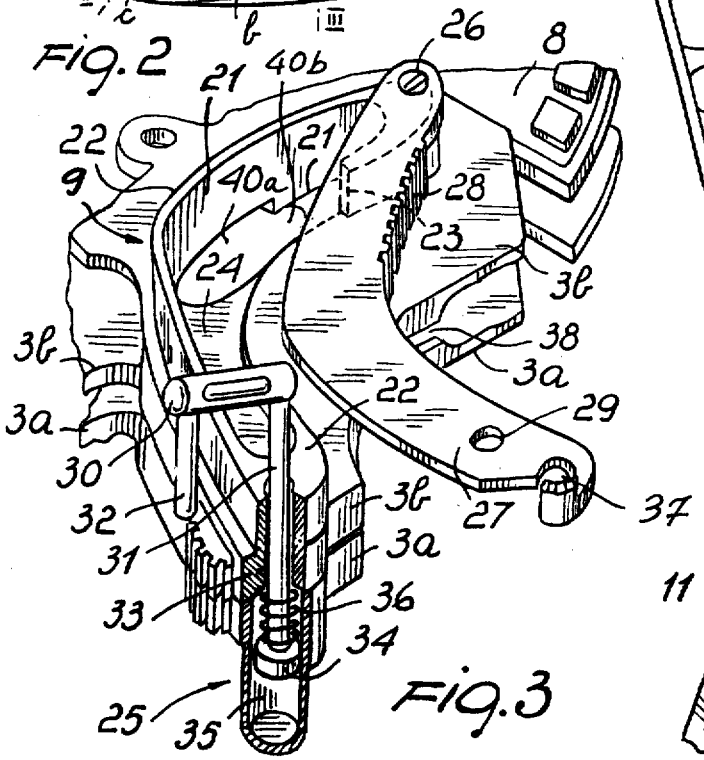
FIG. 3 is a perspective, partly cut-away view of a detail of this pistol.
Figure 4:
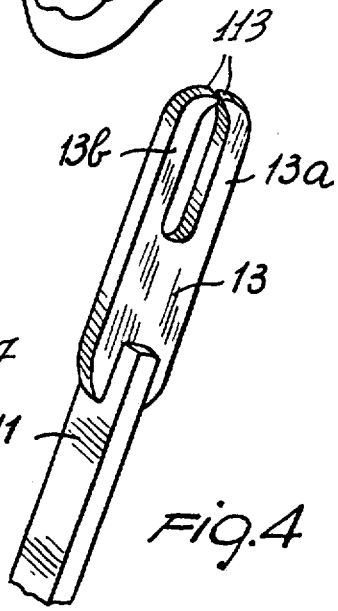
FIG. 4 is a perspective view of the gripper-like end of said lever.

The boomerang 2 is preferably formed as by molding from a plastics material, and has a typical "L" shape, with two essentially flat arms a and b. The boomerang 2 contour includes an apex c, a concave region d and two ends f,g. Moreover, the cross-section of the boomerang is variable longitudinally and three such cross-sections, as taken along the planes I—I, II—II and III—III, are shown in FIG. 2.

The pistol 1 includes a grip 5, a bridge 6 defining a compartment 6*a* wherein a trigger 7 is movable, an upper circular sector region 8, and a boomerang magazine 9 formed on one side of the pistol, between the grip 5 and region 8.

Between the two plates 3*a*, 3*b*, at the region 8, there is defined a launching chamber 10, wherein there is guided a gripping and throwing lever 11, journalled to the pin 12.

Figure 5:
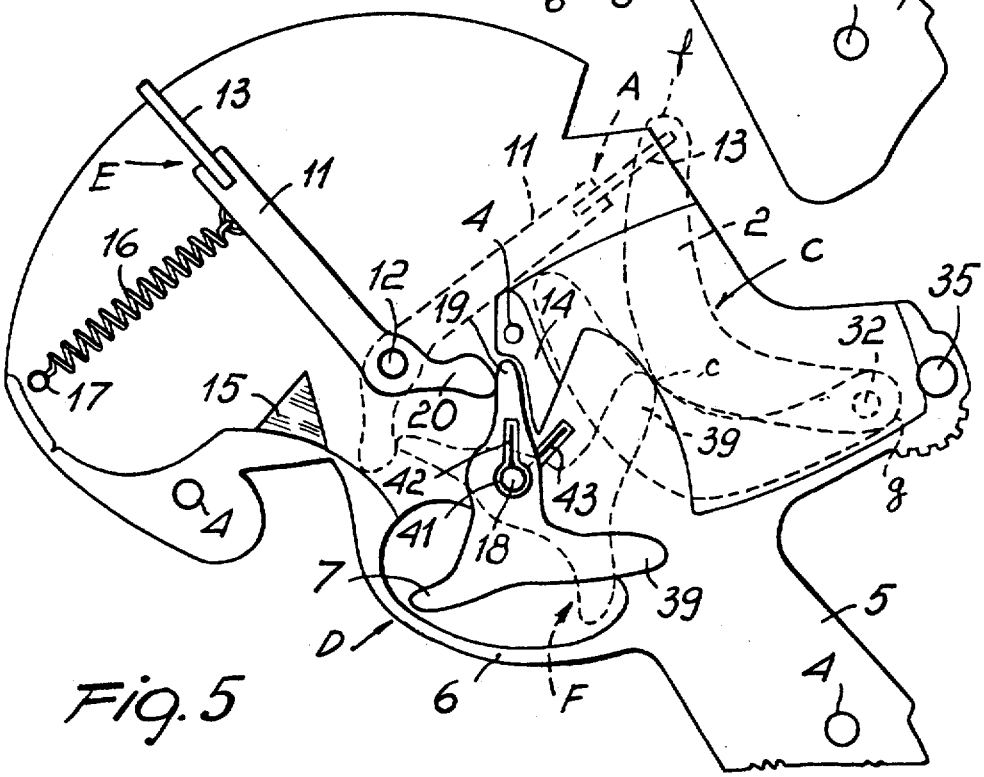

The lever 11 has its top configured as an elastic gripper, preferably comprising a yoke 13 between the arms 13*a* and 13*b* whereof a boomerang 2 can be arranged coplanar with the chamber 10. In the chamber 10, the lever 11 is movable between a rear position and a front position; in the rear position, which in FIG. 5 is shown in dotted lines and designated with the reference symbol A, the lever 11 contacts an abutment plate 14 provided on the plate 3*a*; in the front position, which is even more advanced than the position B shown in dotted lines in FIG. 6, the lever 11 engages a stop 15, preferably of rubber.

The lever 11 is subjected to the action of elastic means comprising a coil spring 16, which is secured with one end to the upper portion of the lever 11, and with the other end to a pin or peg 17, associated to the plate 3*a* on the front portion of the pistol body.

The load/release trigger is journalled to the pistol body at 18, below the lever 10. The trigger 7 has formed integral therewith a cam element 19 adapted for acting on a shaped extension 20 of the lever 11.

In one side of one plate 3*b*, between the circular sector region 8 and the grip 5, there is formed a through slot 21 of boomerang-like shape, which is arranged such that its arms, corrensponding to the arms a-b of the boomerang, are substantially oriented one upwards and the other rearwards. The slot 21 is bordered by a rib or rim 22 which protrudes frontally from the outer surface of the plate 3*b* and which, at the concave portion of the slot edge, has a cutout 23. The slot 21 and rim 22 form said magazine 9, which is provided with a bottom 24 formed by the inner surface of the other plate 3*a*. In the magazine 9, are arranged a group of boomerangs 2, which are pressed against one another and the bottom 24 by a spring loaded device 25 located at the rear end of the magazine. At the top end of the slot 21, the rim 22 carries hinged thereto through a pin 26, a cover 27 for the magazine, which cover is fashioned in the shape of a boomerang and is provided at the concave portion of its edge with a lug or wing 28 facing the plate 3*b*. In the closed position of the cover, the wing 28 occupies the cutout 23.

In that closed position, the cover 27 can be secured rigidly to the body of the pistol by means of the spring loaded device 25 and of a detent hole 29 formed in the cover close to the opposite end to the one whereto it is hinged. The spring loaded device 25 comprises a U-like bridge 30 having two legs or stems 31 and 32 of different length. One stem 31 is slidably and rotatably guided in a through hole 33 in the plate 3*b* and terminates in an embossment 34, which is located in one seat 35 in the other plate 3*a*. Between the embossment 34 and plate 3*b*, there is interposed a coil spring 36 of the compression type, adapted for biasing the stem 31 toward the bottom of the seat 35. The other stem 32 of the bridge is adapted for penetrating the magazine 9 through the detent or reference hole 29 in the cover, such as to push on the group of boomerangs, loaded in the magazine, at the rear ends g thereof. Moreover, the end of the cover 27 opposite from the one whereat it is hinged defines a sort of hook 37 which, in the closed position, abuts and engages the stem 31.

Directly at the rear of the magazine 9, in the plate 3*b*, there is defined a housing 38 facing the bottom 24 of the magazine and intended to receive one boomerang 2 at a time. In fact, the boomerang being pressed against the bottom 24 by the device 25, is adapted to be urged into the housing 38 by the ejector 39, as defined by the trigger 7, until it reaches the position C (FIG. 5), whereat the top end f of the boomerang is located in the chamber 10 ready to be gripped in the elastic yoke 13. The ejector 39 essentially acts against the apex c of said boomerang and penetrates thus the magazine 9 at the apex thereof and at a related passageway 40*a*, which is defined in the inner face of the plate 3*b*, by a reduction in said plate thickness.

For strength reasons, all the parts of the trigger 7, and accordingly the ejector 39 itself, have a thickness dimension exceeding that of a boomerang 2; consequently, in pushing one boomerang at a time out of the magazine 9, the ejector 39 will span the magazine and only act on the boomerang with that portion of its thickness which has the same thickness as the boomerang; as for the other portion of its thickness, the ejector will move inside a depression 40*b*, formed in the inner face of the plate 3*a* and occupying a region of the bottom 24 of the magazine. It should be noted that the trigger 7 is biased to its normal condition D (FIG. 5) by elastic means comprising of preference a torsion spring 41 arranged around the pin 18 and having one end received in a slot 42 on the cam element and the other end secured at 43 to the pistol body.

The toy pistol according to the invention operates as follows.

Figure 6:
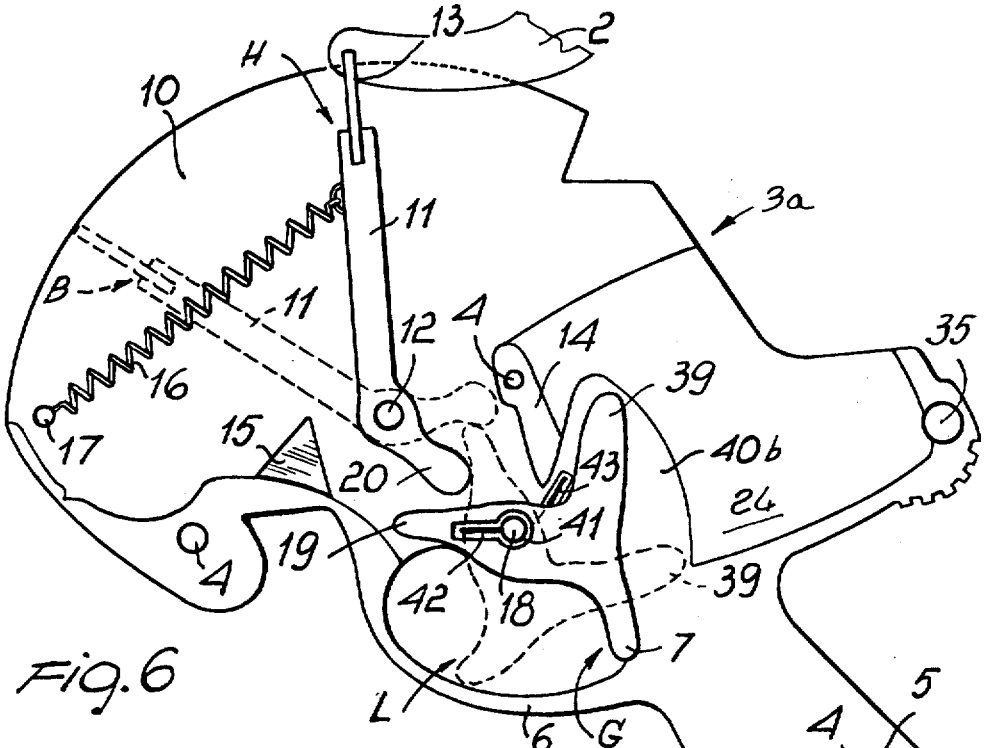
FIGS. 5 and 6 are side views of the open pistol to show its related components in various mutual positions.

To load a group of boomerangs into the magazine 9, the bridge 30 is first raised and rotated to withdraw the stem 31 from the reference or detent hole 29 and release the cover 27. Into the magazine, the boomerangs are positioned one on top of the other, then the cover 27 is closed bringing its end 37 against the stem 31 and inserting the stem 32 into the detent hole 29. The stem 32 now applies a push or pressure on the rear end g of the boomerangs such as to hold them, first of all, pressed against the bottom 24; at the same time, however, the planes containing the various boomerangs are advantageously slightly divergent from one another, from said end g. Ordinarily, the trigger 7 and lever 11 will be occupying their respective positions D and E (FIG. 5), whereat the cam element 19 of the trigger is resting against the extension 20 of the lever 11, which extension is located in front of said element 19. As the trigger 7 is pulled (FIG. 5) and rotated rearwards from the position D to the position F, the cam 19 of the trigger entrains the extension 20 of the lever 11, which is thus forced to move through its angular stroke from the position E to the position A, i.e. toward the magazine 9 and housing 38. With the trigger and lever pivoting respectively from A to F and E to A, the spring 16 is loaded as well as the spring 41. Simultaneously therewith, the ejector 39 of the trigger penetrates the magazine 9 and urges the boomerang 2, held by the spring loaded device 25, in direct contact with the bottom 24, in the housing 38. That boomerang will then move into the gripping position C, its rear end g being rotated about the axis of the stem 32; the other boomerangs contained in the magazine 9 are now resting on their ends g, which are in the position C, and adjacent the ejector 39, which has moved into the magazine. As the lever 11 arrives at A and one boomerang at C, the top end f of this boomerang enters and engages in the elastic yoke 13 of the lever itself, the legs 13*a–b* of the yoke gripping the end f with their opposed pointed terminations 113. At this point, the trigger, which is still pulled, has reached its travel end G and its cam 19 disengages from the extension of the lever 11, which under the action of the loaded spring 16, snaps sharply forward entraining the boomerang therealong; upon the end g of the boomerang being also ejected from the magazine 9, said end will tend by centrifugal force to move out of the pistol body, which has the housing 38 and chamber 10 open outwardly, along the upper contour of the pistol; during its forced entrainment, the boomerang is thus obliged to perform a counterclockwise rotation about the point where the terminations 113 of the elastic yoke 13 are clamped onto its end f (FIG. 6). As the lever 11 keeps moving away from A and the boomerang moves outwards, the force tending to pull the boomerang out of the grip in the yoke 13 increases; thus, immediately past the position H, the boomerang will overcome the gripping force and become airborne, it having both a rotational and translatory type of motion such as to follow a typical path. After the boomerang has been launched, the lever 11 will continue its forward movement until it strikes the stop 15, whilst the spring 16, being now unloaded, deflects; as the spring is released, the lever will rebound back to the position B. Upon releasing the trigger 7, the latter, under the bias of the spring 41, will reach the position L (FIG. 6), whereat the cam 19 acts on the extension 20 of the lever 11 from below, and raises it until in engagement with the rear portion thereof, thereby the trigger and lever resume their normal condition D and E, and the pistol is ready for a fresh launch. The ejector 39 will in fact have moved now out of the magazine 9, against the bottom 24 thereof the spring loaded device 25 is urging the boomerangs left in the magazine.

The toy pistol just described, therefore, is capable of easily and effectively throw or launch small boomerangs; the size of the boomerangs and the push imparted thereto are of course provided such as not to create hazard. Being provided with a magazine, moreover, the pistol will be able to launch in quick succession a whole series of such boomerangs.

In practicing this toy pistol, the materials used, as well as the shapes and dimensions, may be any ones to suit individual applicational requirements.

I claim:

1. A toy pistol for repeated launching of boomerangs comprising:

a body defining a grip and a launching chamber for the boomerangs, a magazine formed in said body above said grip, in which a plurality of boomerangs are arranged in side by side relationship, said magazine having a bottom against which the boomerangs are pressed by means of a spring loaded device, a boomerang projecting lever journalled in said launching chamber and having gripping means at its free end for releasable retention of boomerang and a shaped extension, spring means arranged in said launching chamber and operatively associated to said lever to urge the latter for projection of a boomerang, a housing slot formed in said body and communicating with said magazine for receiving the boomerang resting on the bottom of said magazine, a trigger rotatably supported in said body and having a cam portion in operative engagement with said shaped extension and an ejecting portion adapted to penetrate said magazine, actuation of said trigger causing along a first rotational movement thereof said ejecting portion to enter said magazine for urging the boomerang resting on the bottom of the magazine into said housing slot and said cam portion to engage said extension to rotate said lever from a resting position in a position in which the gripping means grip the urged boomerang at one end thereof, whereas along an additional rotational movement of said trigger said cam portion disengages from said extension thus permitting said lever under the action of said spring means to snap back into said resting position, whereby the gripped boomerang is entrained out of said housing slot and thrown away.

2. A toy pistol as claimed in claim 1, wherein said magazine comprises a cavity having a boomerang-like shape and a cover for said cavity having a hinged end and an end opposite to said hinged end provided with a hole and a hook portion, and wherein said spring loaded device comprises a bridge member and a pair of parallel stems extending from said bridge member, a first stem of said pair being adapted to penetrate said hole and the second stem being slidably and pivotally mounted on said body outside of said magazine and engageable by said hook portion in order to retain said cover in closed condition of said cavity, a spring being further provided axially acting on said second stem so as to cause said first stem to pass through said hole into said cavity and to hold the boomerangs arranged therein pressed against the bottom of the magazine.

3. A toy pistol as claimed in claim 1, wherein said gripping means comprises a yoke which is constituted by two arms having opposite terminations adapted for elastically retention of a boomerang.

* * * * *